US010527022B2

(12) United States Patent
Recoura

(10) Patent No.: US 10,527,022 B2
(45) Date of Patent: Jan. 7, 2020

(54) HYDRAULIC APPARATUS HAVING AN ADDITIONAL THRUST SECTION

(71) Applicant: POCLAIN HYDRAULICS INDUSTRIE, Verberie (FR)

(72) Inventor: Clement Philippe Recoura, Verberie (FR)

(73) Assignee: POCLAIN HYDRAULICS INDUSTRIE, Verberie (FR)

( * ) Notice: Subject to any disclaimer, the term of this patent is extended or adjusted under 35 U.S.C. 154(b) by 435 days.

(21) Appl. No.: 15/300,743

(22) PCT Filed: Apr. 1, 2015

(86) PCT No.: PCT/EP2015/057182
§ 371 (c)(1),
(2) Date: Sep. 29, 2016

(87) PCT Pub. No.: WO2015/150456
PCT Pub. Date: Oct. 8, 2015

(65) Prior Publication Data

US 2017/0022965 A1 Jan. 26, 2017

(30) Foreign Application Priority Data

Apr. 2, 2014 (FR) ..... 14 52924

(51) Int. Cl.
*F03C 1/22* (2006.01)
*F04B 49/02* (2006.01)
*F03C 1/00* (2006.01)

(52) U.S. Cl.
CPC ..... *F03C 1/223* (2013.01); *F03C 1/003* (2013.01); *F04B 1/1133* (2013.01); *F04B 49/02* (2013.01)

(58) Field of Classification Search
CPC ..... F03C 1/045; F03C 1/003; F03C 1/223; F04B 1/1133; F04B 49/02
See application file for complete search history.

(56) References Cited

U.S. PATENT DOCUMENTS 4,898,076 A * 2/1990 Bigo ..... F03C 1/045 91/491

FOREIGN PATENT DOCUMENTS

| | | |
|---|---|---|
| FR | 2 651 836 A1 | 3/1991 |
| FR | 2 892 775 A1 | 5/2007 |
| FR | 2 955 903 A1 | 8/2011 |

OTHER PUBLICATIONS

Search Report in French Application No. 1452924 dated Dec. 24, 2014, with English translation coversheet. 8 pages.

(Continued)

*Primary Examiner* — Abiy Teka
(74) *Attorney, Agent, or Firm* — Womble Bond Dickinson (US) LLP

(57) ABSTRACT

The invention relates to a valve assembly (50) of a radial piston hydraulic apparatus (1). Said apparatus includes a cylinder block (4) insertable onto a shaft (2) by translation. Said assembly (50) includes: a valve (51) in contact with said cylinder block (4); a valve train cover (52); and a first (541) and second (542) chamber that are defined, respectively, by a first (511, 521) and second (512, 522) space that are located at the interface between said valve (51) and said valve train cover (52), and are intended for the pressurized fluids that enable the conversion of pressure and/or mechanical stress. Said assembly (50) includes an additional section (54) defined by a third space (541, 542) located at the interface between said valve (51) and said valve train cover (52). Said section (54) is intended for receiving a pressurized fluid such as to enable the cylinder block (4) to be inserted onto the shaft (2).

12 Claims, 4 Drawing Sheets

(56) References Cited

OTHER PUBLICATIONS

International Search Report and Written Opinion in PCT/EP2015/057182 with English translation. 13 pages.

* cited by examiner

HYDRAULIC APPARATUS HAVING AN ADDITIONAL THRUST SECTION

GENERAL TECHNICAL FIELD

The present invention relates to the field of hydraulic devices.

In particular, it relates to associated means for allowing the coupling of such hydraulic devices.

PRIOR ART

Figure 1A:
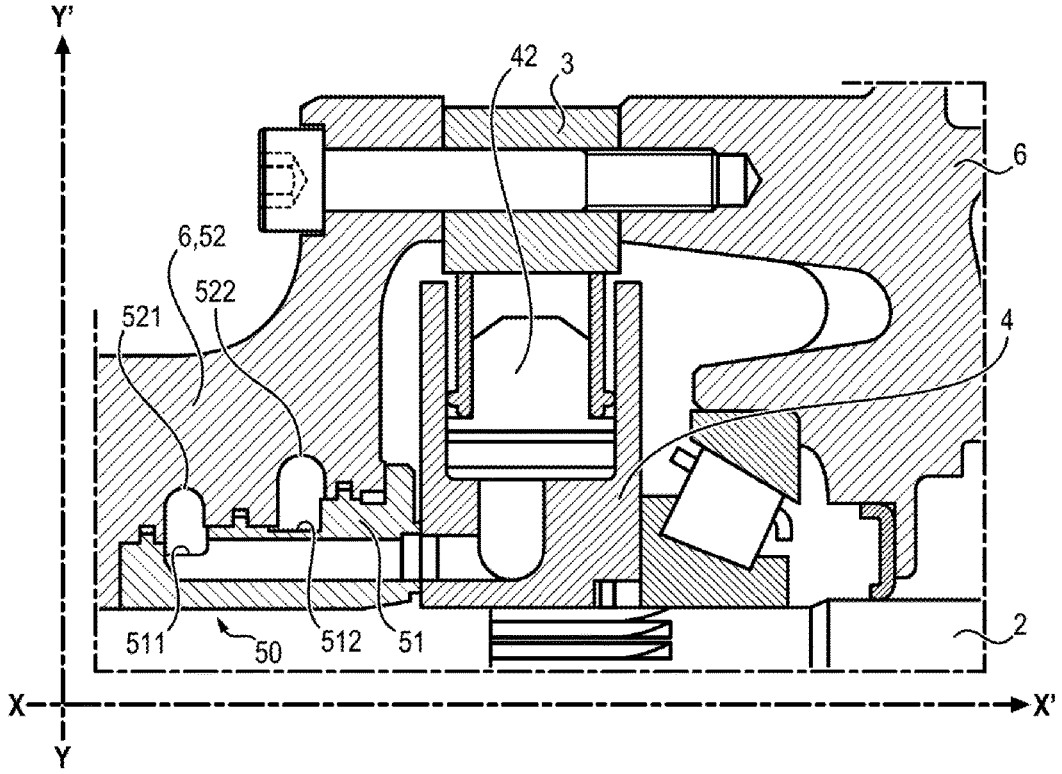
FIG. 1a PRIOR ART
Figure 1B:
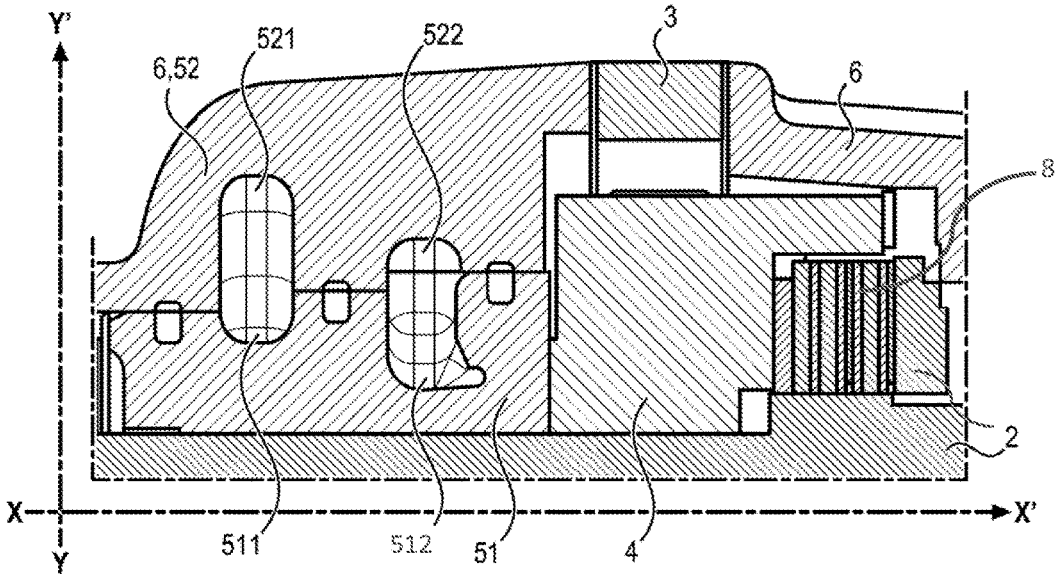
FIG. 1b PRIOR ART

In all of the present text, a device capable of operating as a motor or as a hydraulic pump will be designated a hydraulic device. As shown in FIGS. 1*a* and 1*b*, a hydraulic device 1 comprises a shaft 2, a cam 3, typically a multilobe cam, a cylinder block 4, a valve plate or distribution assembly 5 comprising a distributor 51 and a distributor cover 52, and a casing 6.

The cylinder block 4 is placed inside the annulus forming the cam 3. It defines a plurality of cylinders 41 oriented radially with respect to an axis X-X' of rotation (see FIGS. 1*a* and 1*b*) and leading to the outer peripheral face of the cylinder block 4 facing the cam 3.

A piston 42 is mounted with radial sliding respectively in each of the cylinders 41. Each piston 42 is supported by the radially inner surface of the cam 3.

The cylinder block 4 has a central bore by which it can be engaged on the end of the shaft 2 of the hydraulic device 1.

The valve plate or distribution assembly 50 is formed from a distributor 51 and a distributor cover 52 which are adapted to apply in a controlled manner a fluid under pressure successively to each of the pistons 42, more precisely in the inner chamber of the cylinders 41 adjacent to the pistons, so that the successive thrust of the pistons 42 on the lobes of the cam 3 drives the relative rotation of the cylinder block 4 and of the elements which are linked to it with respect to the cam 3. The distributor 51 is movable in rotation along an axis co-linear with X-X', which is the axis of the shaft 2.

The valve plate or distribution assembly 50 comprises in particular two chambers 511, 521 and 512, 522 receiving a fluid under high or low-pressure depending on the mode of operation of the device.

Hydraulic devices are known which have a clutch release and clutch mechanism 8 based on thrust, thus allowing a free wheel configuration, i.e. the hydraulic device 1 operates without pressure (the pistons 42 therefore not carrying out reciprocating movements in contact with the cam 3) and an operating configuration, i.e. a configuration in which the hydraulic device operates with fluid pressure and flow, the pistons 42 carrying out a reciprocating movement in contact with the cam.

When the clutch 8 is engaged, it is necessary to engage the cylinder block 4 on the shaft 2 so that said block 4 can transmit its torque. This engagement is accomplished in particular by the valve plate or distribution assembly 50. In addition, the distribution assembly 50 supplies the cylinder block 4 with fluids under pressure. The sealing between said cylinder block 4 and said distribution assembly 50 is possible without a gasket thanks to permanent contact between the two.

To transmit torque without allowing the clutch 8 to slip, it is necessary to have considerable thrust by the distribution assembly 50 on the cylinder block 4. Until now, this thrust is exerted by the fluids under pressure in the two chambers 511, 521 and 512, 522 of the distribution assembly 50, so-called high-pressure chamber and low-pressure chamber depending on the mode of operation of the device.

Thus the fluids under pressure exert on the distributor 51, via these chambers 511, 521 and 512, 522, a force along the axis X-X' of the shaft 2, the distributor 51 then pressing against the cylinder block 4 and thus allowing the cylinder block 4 to engage on the shaft 2. The high pressure is typically comprised between 400 and 500 bars.

More precisely, the chambers 511, 521, and 512, 522 comprise two grooves 511 and 512 at the interface between the distributor 51 and the cover 52 for conveying the fluid, which cooperate with two complementary grooves 521 and 522 provided in the cover of the distributor 52 so as to form chambers or channels. Depending on the mode of operation of the hydraulic device 1, each channel can be low or high pressure and is adapted to be respectively coupled to a hydraulic supply circuit 71, 72 (see FIGS. 3*a* and 3*b*). Each circuit can be low or high pressure depending on the operating mode.

The grooves 511 and 512 provided in the distributor 51 each have a side wall on the side in the direction of the cylinder block 4.

Thus, as mentioned previously, the supply of fluid under high or low-pressure will tend to displace the distributor 51 toward the cylinder block 4 under the influence of the force resulting from the pressure applied to its side walls.

In this manner, the level of engagement of the cylinder block 4 on the shaft 2 depends directly on pressure, said pressure itself being correlated to the torque of the device 1.

The pressure applied to engage the cylinder block 4 on the shaft 2 is therefore not constant, which is not desirable for a clutch. In particular, at starting, in order to obtain a satisfactory level of engagement, it is necessary to have a rather high minimum pressure, which implies in any case a strong boost level, the boost being supplied by a pump 9 so-called a booster pump, which ensures a minimum pressurization of the hydraulic circuits 71, 72. The boost pressure is on the order of the lower pressure, that is to say typically about ten bars.

The objective is therefore to provide a new device allowing the engagement of the cylinder block 4 on the shaft 2 to be improved.

PRESENTATION OF THE INVENTION

The present invention aims to propose a system not having such disadvantages.

To that end, the invention relates to a distribution assembly of a hydraulic device with radial pistons, said device comprising a cylinder block which can be engaged on a shaft by translation, said assembly comprising:

A distributor, in contact with said cylinder block,

A distribution cover,

A first and a second chambers defined respectively by a first and a second volumes located at the interface between said distributor and said distribution cover, and intended for fluids under pressure allowing mechanical-pressure conversion, said assembly being characterized in that it further comprises an additional section defined by a third volume located at the interface between said distributor and said distribution cover, said section being intended to receive a fluid under pressure to allow the engagement of the cylinder block on the shaft.

In addition, the invention can comprise the following features, taken alone or in combination:

the additional section is entirely or partly located radially outside the first and second chambers, so that the surface of said additional section is greater.

the supplying of the additional section is accomplished by selection of the lowest pressure between the two pressures relating to the first and second chambers.

the distribution assembly comprises a low-pressure selector with an open center adapted to carry out the selection of the lowest pressure between the two pressures relating to the first and second chambers.

the additional section is not radially rectilinear, but is typically S or Z-shaped, so as to optimize the volume and the sealing.

Another object of the invention relates to a hydraulic device including a distribution assembly as previously described, said assembly allowing in particular the engagement of said cylinder block on said shaft.

In addition, the invention can comprise the following features, taken alone or in combination:

the distributor cover and the casing are integral or form one and the same part.

the engagement of the cylinder block on the shaft is part of a clutch and clutch release system.

Finally, a final object of the invention relates to an engagement method of a cylinder block of a hydraulic device on a shaft, by means of a distribution assembly previously described in which:

The additional section is pressurized by a fluid,

The distributor is biased consecutively to the pressurization by a fluid of the additional section, The distributor biases by contact the cylinder block for engagement of said cylinder block on the shaft.

PRESENTATION OF THE FIGURES

Figure 2A:
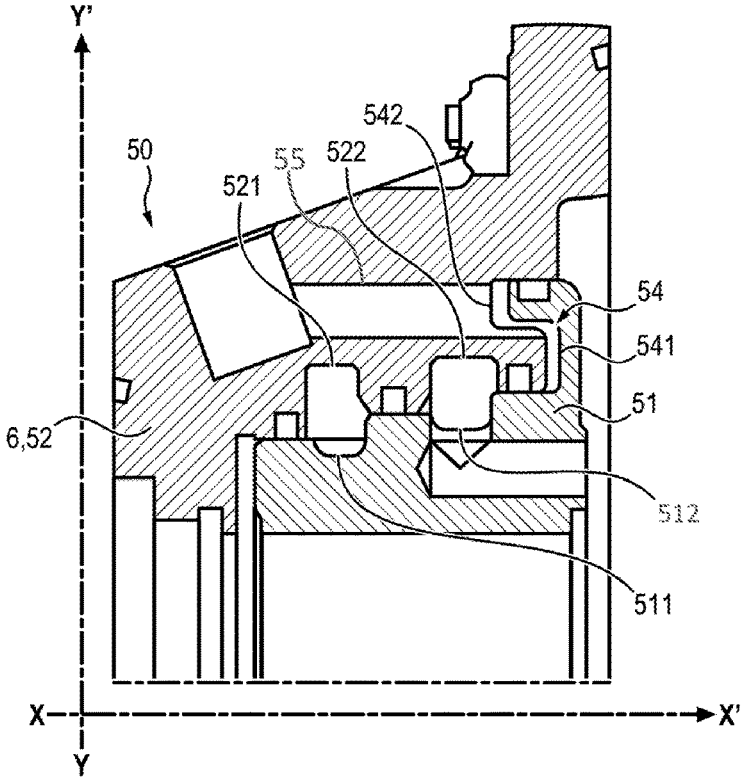
Figure 2B:
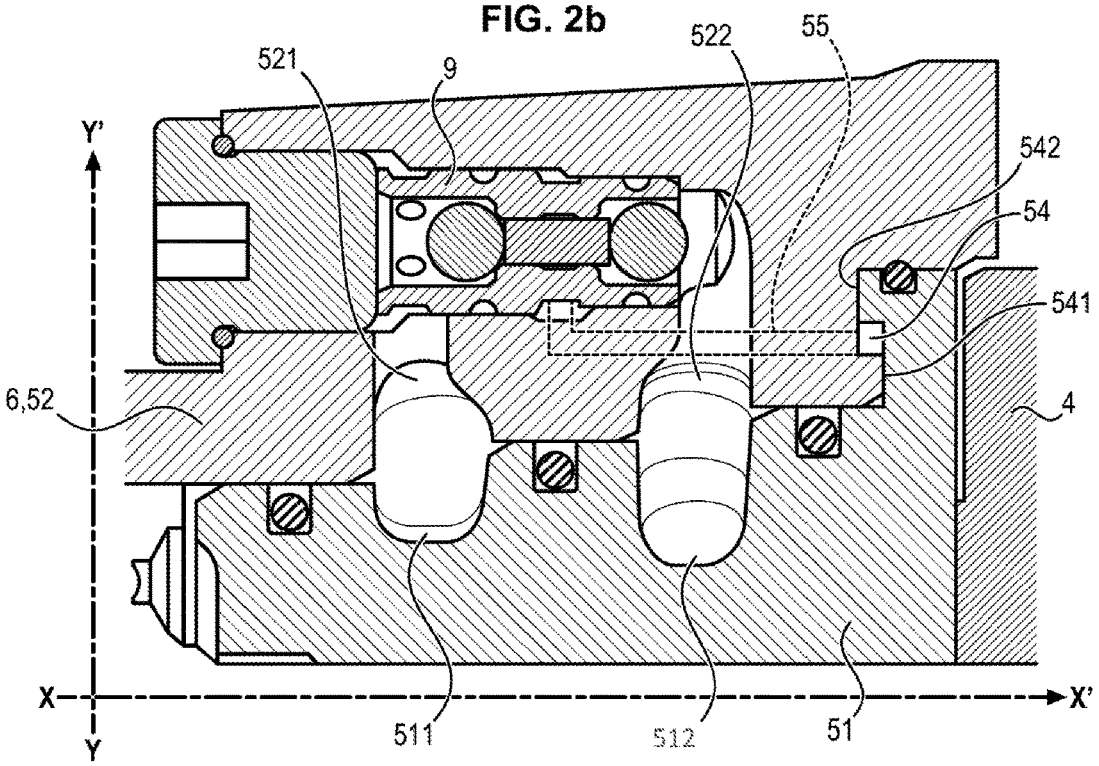
Figure 3A:
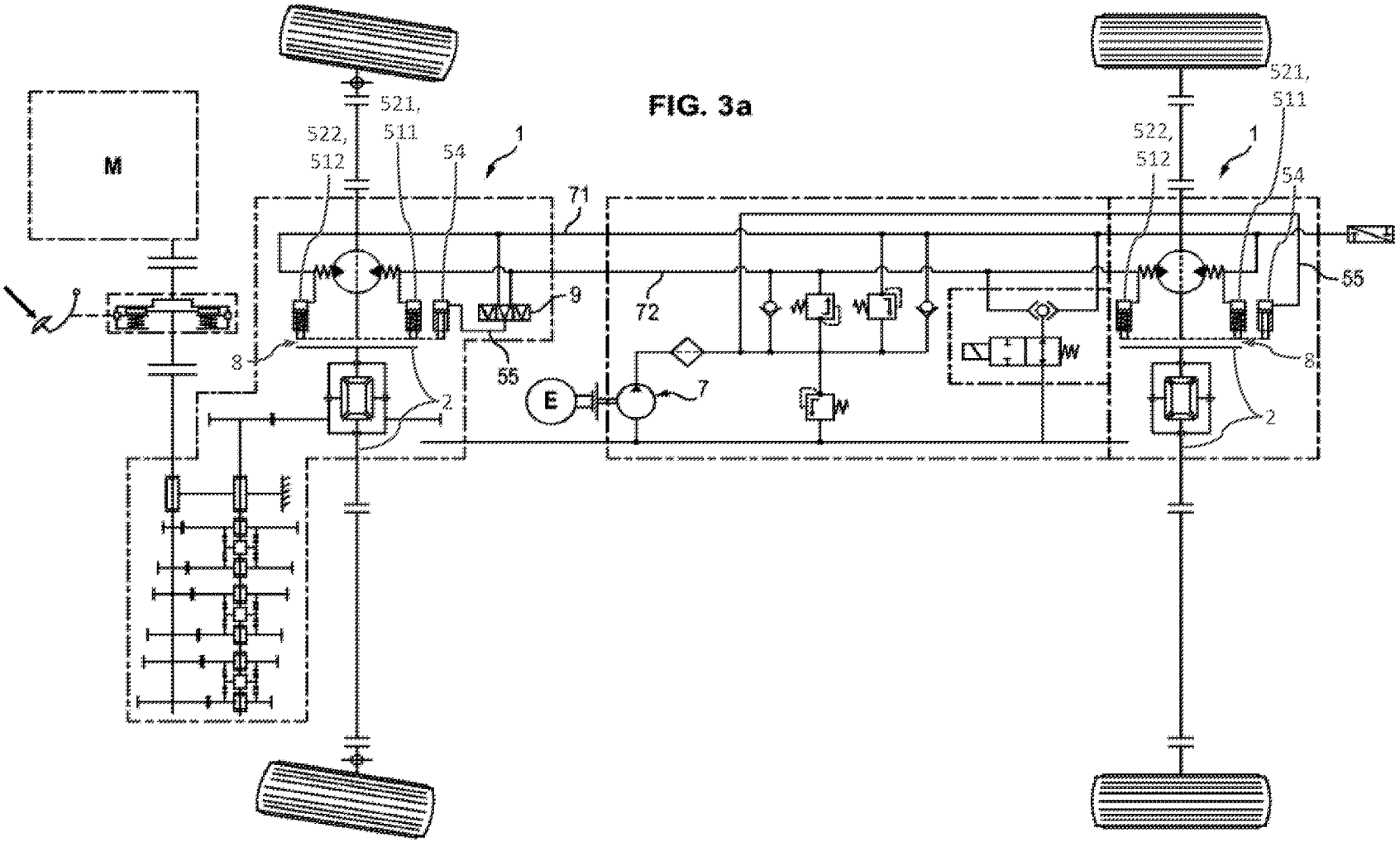
Figure 3B:
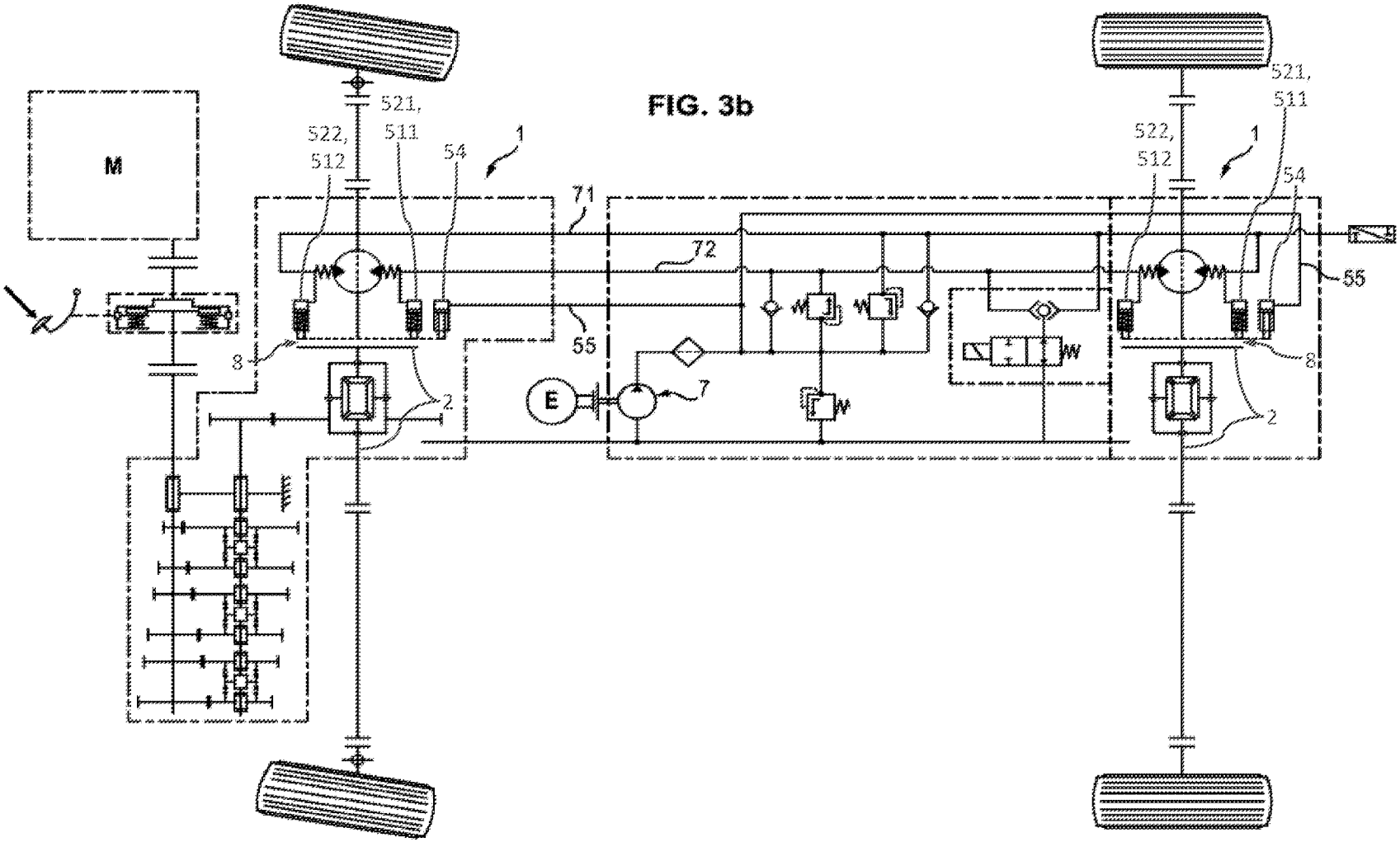

Other features, aims and advantages of the invention will be revealed by the description that follows, which is purely illustrative and not limiting, and which must be read with reference to the appended drawings, in which:

FIG. 1*a* shows a schematic of a partial section view of a device belonging to the prior art, FIG. 1*b* shows a section view of a hydraulic device belonging to the prior art, FIG. 2*a* shows a schematic of a partial section view of a variant of a hydraulic device according to one aspect of the invention, FIG. 2*b* shows a section view of a hydraulic device conforming to the invention, FIGS. 3*a* and 3*b* show two views of an example of integration of one variant of the hydraulic device according to one aspect of the invention on a vehicle axle, In all the figures, the common elements are labeled with identical numerical references.

DETAILED DESCRIPTION OF AT LEAST ONE EMBODIMENT

FIG. 2*a* shows a partial section view of a hydraulic device and of a distribution assembly according to one embodiment of the invention. As for FIGS. 1*a* and 1*b*, the axis of rotation X-X' of the hydraulic device and a radial extension axis Y-Y' are shown in FIGS. 2*a* and 2*b*.

The common elements with the prior art previously described have the same denominations and alphanumeric references.

The general operation of the hydraulic device has been broadly described in documents FR 2955903 A1 and FR 2651836 A1, among others.

As mentioned previously, one of the embodiments of the clutch system consists of engaging by translation the cylinder block 4 on the shaft 2.

A distribution plane 53 is defined between the distributor 51 and the cylinder block 4, corresponding to the faces of the distributor 51 and of the cylinder block 4 adapted to be put in contact with one another.

In addition, sealing is provided by the particular configuration of the grooves 511 and 512 which provide for self-locking between the cylinder block 4 the distributor 51.

The distributor cover 52 is typically fixed and integral with the casing 6, and in particular fixed in translation along the axis X-X'. Alternatively, the distributor cover 52 can form one and the same part with the casing 6.

An additional section 54 is added between the distributor 51 and the cover 52. This additional section 54 is a volume in which a fluid under pressure can circulate. A first internal wall 541 of said additional section is constituted by the distributor 51 and a second internal wall 542 is constituted by the cover 52.

In a broadly preferred manner, the surface of the first wall 541 is substantially perpendicular to the shaft 2 and is as large as possible.

The additional section 54 is preferably entirely or partly located radially outside the channels 511, 521 and 512, 522 along axis Y-Y'. In fact, the assembly being generally a cylinder of revolution around the axis X-X', the more the additional section 54 is located radially outward, the greater the surface of the first wall 541 of the additional section 54 can be.

Preferably, the additional section is preferably located longitudinally between the cylinder block 4 and the two chambers 511, 521, 512, 522. Sealing means 543 are also provided, such as gaskets, to seal the additional section 54 intended to receive a fluid under pressure.

According to a preferred embodiment, the additional section 54 has an S or Z shape. Such a shape makes it possible to optimize the volume gain and allows the gaskets 543 to be housed by axial sliding. Alternatively, the additional section 54 is rectilinear.

The additional section 54 is intended to be supplied with a fluid under pressure via a supply channel 55 positioned in the cover of the distributor. Thanks to the surface area of the first wall 541, the fluid under pressure exerts a force colinear with the axis X-X' on the distributor 51. The distributor 51 being in contact with the cylinder block 4 through the contact surface 53, the force is transmitted to the cylinder block 4 which engages itself on the shaft 2.

The force induced by the fluid under pressure on the distributor 51, indirectly on the cylinder block 4, being proportional to the surface area of the first wall 541, the maximization of this surface area allows the minimization of the pressure of the fluid, with a constant force.

According to a first embodiment (FIGS. 2*b* and 3*a*), the additional section is supplied by the lowest pressure of the two hydraulic supply circuits 71, 72. As previously mentioned, the two hydraulic circuits 71, 72 can be low or high pressure depending on the operating mode of the hydraulic device 1. The two hydraulic supply circuits 71, 72 are coupled to a selector 9, said selector 9 being coupled to the additional section 54 through the supply channel 55. The selector 9 is adapted to select the lowest pressure between the two hydraulic supply circuits 71, 72. The inputs to the selector 9 are connected to the two hydraulic circuits 71, 72, each of which can be high pressure or low-pressure. The output of the selector 9 is connected to the supply channel 55.

Preferably, the selector 9 is a selector with an open center: in fact, in particular during starting of the hydraulic device, the two hydraulic circuits 71, 72 are brought to a boost pressure by the pump 7 so-called a booster pump, shown schematically (FIGS. 3*a* and 3*b*) as a hydraulic pump. The pressures in the two hydraulic circuits 71, 72 being at that moment almost equivalent, the selector 9 with an open center will allow the supplying of the additional section 54 immediately upon starting of the hydraulic device 1.

The supply channel 55 links the selector 9 to the additional section 54. For reasons of use of space, said supply channel 55 is located advantageously entirely or at least in part in another plane than the additional section 54 (supply channel 55 shown in dashes in FIG. 2*b*).

According to a second embodiment (FIG. 3*b*), the additional section 54 is directly supplied by the booster pump 7 via the supply channel 55.

The concerned hydraulic devices 1 typically have radial pistons 42 and multilobe cams 3. In particular, when the device 1 is in the free wheel configuration, the pistons 42 are held in contact with the cam 3 by compression springs.

The invention claimed is:

1. A distribution assembly of a hydraulic device with radial pistons, said device comprising a cylinder block which is engagable on a shaft by translation, said assembly comprising:

a distributor, in contact with said cylinder block, a distribution cover, where the distributor is movable with respect to the distribution cover, a first chamber and a second chamber defined respectively by a first volume and a second volume located at the interface between said distributor and said distribution cover, and for receiving fluids under pressure allowing rotation of the cylinder block, wherein the distribution assembly comprises an additional section defined by a third volume located at the interface between said distributor and said distribution cover, said section for receiving said fluids under pressure to allow the engagement of the cylinder block on the shaft by a clutch which operates by moving the distributor against the cylinder block, and moving the distributor away from the cylinder block upon release of said fluids under pressure.

2. The distribution assembly according to claim 1, wherein the additional section is entirely or partly located radially outside the first and second chambers.

3. The distribution assembly according to claim 1, wherein a reception of fluid under pressure on the additional section is accomplished by selection of the lowest pressure between the two pressure relating to the first and second chambers.

4. The distribution assembly according to claim 3, wherein the distribution assembly comprises a low-pressure selector with an open center adapted to carry out the selection of the lowest pressure between the two pressures relating to the first and second chambers.

5. The distribution assembly according to claim 1, wherein the additional section is not radially rectilinear, so as to optimize the volume and the sealing.

6. A hydraulic device according to claim 1, wherein said assembly allows the engagement of said cylinder block on said shaft by longitudinal translation.

7. The hydraulic device according to claim 6, wherein the distributor cover and the casing are integral or form one and the same part.

8. The hydraulic device according to claim 7, wherein the engagement of the cylinder block on the shaft is part of a clutch and clutch release system.

9. The hydraulic device according to claim 6, wherein the device has radial pistons and multilobe cam.

10. The hydraulic device according to claim 9, wherein the pistons are held in contact with the cam by compression springs.

11. A method for engaging a cylinder block of a hydraulic device on a shaft, by means of a distribution assembly according to claim 1, in which:

a. The additional section is pressurized by a fluid, b. The distributor is biased consecutively to the pressurization by a fluid of the additional section, c. The distributor biases by contact the cylinder block for engagement of said cylinder block on the shaft.

12. The distribution assembly according to claim 1, wherein the additional section is S or Z-shaped to optimize the volume and the sealing.

* * * * *